United States Patent [19]

Jetter

[11] 4,430,006

[45] Feb. 7, 1984

[54] RANDOM MULTIPLE PUSH BUTTON CLOCK ALARM DEACTIVATION SYSTEM

[76] Inventor: Milton W. Jetter, 201 I St., SW., Apt. 838, Washington, D.C. 20024

[21] Appl. No.: 416,348

[22] Filed: Sep. 9, 1982

[51] Int. Cl.[3] ..... G04B 23/02

[52] U.S. Cl. ..... 368/73; 368/262

[58] Field of Search ..... 368/72–74, 368/250, 251, 262

[56] References Cited

U.S. PATENT DOCUMENTS

| | | | |
|---|---|---|---|
| 4,246,651 | 1/1981 | Komatsu et al. | 368/73 |
| 4,352,170 | 9/1982 | Jetter | 368/262 X |
| 4,352,171 | 9/1982 | Jetter | 368/262 X |

*Primary Examiner*—Vit W. Miska

*Attorney, Agent, or Firm*—Herman L. Gordon

[57] ABSTRACT

A clock alarm deactivation system for a clock with an alarm switch for turning on an alarm device at a preset time. The alarm device can be deactivated by manually operating in sequence a series of pushbutton switches. Each pushbutton switch in the sequence is randomly selected and is identified by an individual indicator light. When setting the clock alarm, the user adjusts a selector control that will select the number of pushbutton switches that the user will be required to push in sequence in order to totally deactivate the alarm device. When the clock alarm sounds at the preset time, simultaneously the first pushbutton switch randomly selected is activated and its identifying indicator light is turned on. After the user pushes the first-activated pushbutton switch the alarm is temporarily silenced and the device will randomly select the second pushbutton switch in the sequence and turn on its respective indicator light. The alarm device will remain silenced so long as the user pushes the next pushbutton switch within a specified time after its indicator light has been turned on. Provided that the user successfully follows this procedure for the remaining pushbutton switches selected in the sequence, the alarm will be totally deactivated. If the user takes longer than the specified time to push an active pushbutton switch, the alarm will resume operation and the random pushbutton switch deactivation process will return to its starting point.

20 Claims, 6 Drawing Figures

RANDOM MULTIPLE PUSH BUTTON CLOCK ALARM DEACTIVATION SYSTEM

FIELD OF THE INVENTION

This invention relatees to clock alarm deactivation systems, and more particularly to a clock alarm control system of the type employing a series of pushbutton switches which must be manually operated in a sequence that is randomly selected and identified by the clock mechanism.

BACKGROUND OF THE INVENTION

Alarm clocks have heretofore been provided with various types of deactivation mechanisms and devices for enabling a user to shut off the alarm after it has become activated. In the case of mechanical alarm clocks, manually operated stop devices have been employed. With electrically operated clocks, switch devices or various types of combined mechanical and electrical alarm-deactivation means have been employed. In practically all of the previously employed alarm-deactivation devices, the user is required to operate only one pushbutton switch to deactivate the alarm. This turns out to be a serious disadvantage, since the alarm can be easily deactivated before the user is fully awake, and thus there is a great tempation to go back to sleep, since it takes some time for an awakened person's brain to reach a fully functioning state.

Therefore, a large percentage of prior clock alarm systems fail in their underlying purpose in that individuals learn to defeat these systems without being fully awake, and become accustomed to routinely going back to sleep after turning off the alarm. For this reason there is a definite need for an alarm deactivation system requiring a non-routine behavior pattern which ensures that the user becomes fully awake by the time the alarm is completely deactivated. There is also a need for making the needed time effort required to achieve deactivation adjustable in accordance with the particular waking characteristics of the individual.

SUMMARY OF THE INVENTION

The alarm clock control system of the present invention includes a conventional clock movement and an alarm system which can be deactivated by manually operating in sequence a series of pushbutton switches. Each pushbutton switch in the sequence is randomly selected and identified by an individual indicator light. A clock may incorporate any number of pushbutton switches for use in the deactivation process. However, eight pushbutton switches have been chosen to typically describe this invention. When setting the clock alarm, the operator will adjust a selector control that will select the number of pushbutton switches that the user will be required to push in sequence in order to totally deactivate the alarm. The selector can be readjusted at any time except when the alarm is energized, at which time the selector is latched in its preset condition.

When the clock alarm sounds at the preset time, simultaneously the first deactivation pushbutton switch randomly selected is activated and its identifying indicator light is turned on. After the user pushes the first-activated pushbutton switch, two things will occur: (1) the alarm will be temporarily silenced, and (2) the deactivation mechanism will, within seconds (for example, two seconds later), randomly select the second pushbutton switch in the sequence and turn on its respective indicator light. The alarm will remain silenced so long as the operator pushes the next pushbutton switch within a specified time (for example, within six seconds) after its indicator light has been turned on. Provided that the user successfully follows this procedure for the remaining pushbutton switches selected in sequence, the alarm will be totally deactivated. If the user takes longer than six seconds to push an active pushbutton switch the alarm will resume operation. Also, the random pushbutton switch deactivation process will return to its starting point.

Accordingly, a main object of the invention is to provide an improved clock alarm deactivation system which overcomes the deficiencies and disadvantages of the prior known types of clock alarm-deactivation mechanisms and devices.

A further object of the invention is to provide an improved alarm clock with an electrical control system which can be used in a manner requiring a substantial amount of effort and concentration by the user when attempting to disable the clock alarm, to ensure that the user reaches a fully awakened state as a result of the deactivation procedure, thereby accomplishing the intended purpose of the alarm.

A still further object of the invention is to provide an improved clock alarm system which has an alarm deactivating arrangement with a non-routine pattern which requires the user, with each clock alarm occurrence, to employ a different sequence of actions when he attempts to deactivate the alarm, so that using a familiar deactivation pattern will not turn off the alarm, whereby a special amount of mental concentration on the part of the user will be required with each clock alarm deactivation procedure, since each such procedure requires a different procedural pattern, and wherein compliance with a new procedural pattern is required each time the clock alarm is to be deactivated.

A still further object of the invention is to provide an improved electrical clock alarm system wherein it is necessary for the user to manually actuate a unique series of pushbuttons sequentially identified in a random sequence each time the clock alarm is to be deactivated, and wherein each pushbutton actuation must be accomplished within a predetermined time limit in order to maintain the effectiveness of the procedure and wherein the alarm will be held silent only if the operator pushes the next identified pushbutton within a specified time after said next pushbutton has been identified by the system, failure to maintain the sequence resulting in return of the alarm deactivation system to its starting condition.

A still further object of the invention is to provide an improved electrical clock alarm deactivation system requiring the user to manually operate a randomly-selected sequence of pushbuttons in order to totally deactivate the alarm, and wherein the starting pushbutton in the deactivation sequence can be preset by the user when the user sets the alarm, whereby the degree of effort for alarm deactivation can be adjusted in accordance with the particular waking characteristics of the user.

A still further object of the invention is to provide an improved electrical clock alarm deactivation system requiring a user to manually actuate a randomly-selected series of pushbuttons having a different sequential pattern of actuation for each alarm deactivation procedure, requiring the user to promptly actuate pushbuttons which are sequentially identified by associated lamps during the deactivation procedure, the system employing relatively simple circuitry which is inexpensive to fabricate, which is safe to use, and which is economical in energy usage.

BRIEF DESCRIPTION OF THE DRAWINGS

Further object and advantages of the invention will become apparent from the following description and claims, and from the accompanying drawings, wherein:

DETAILED DESCRIPTION OF A PREFERRED EMBODIMENT

Figure 1:
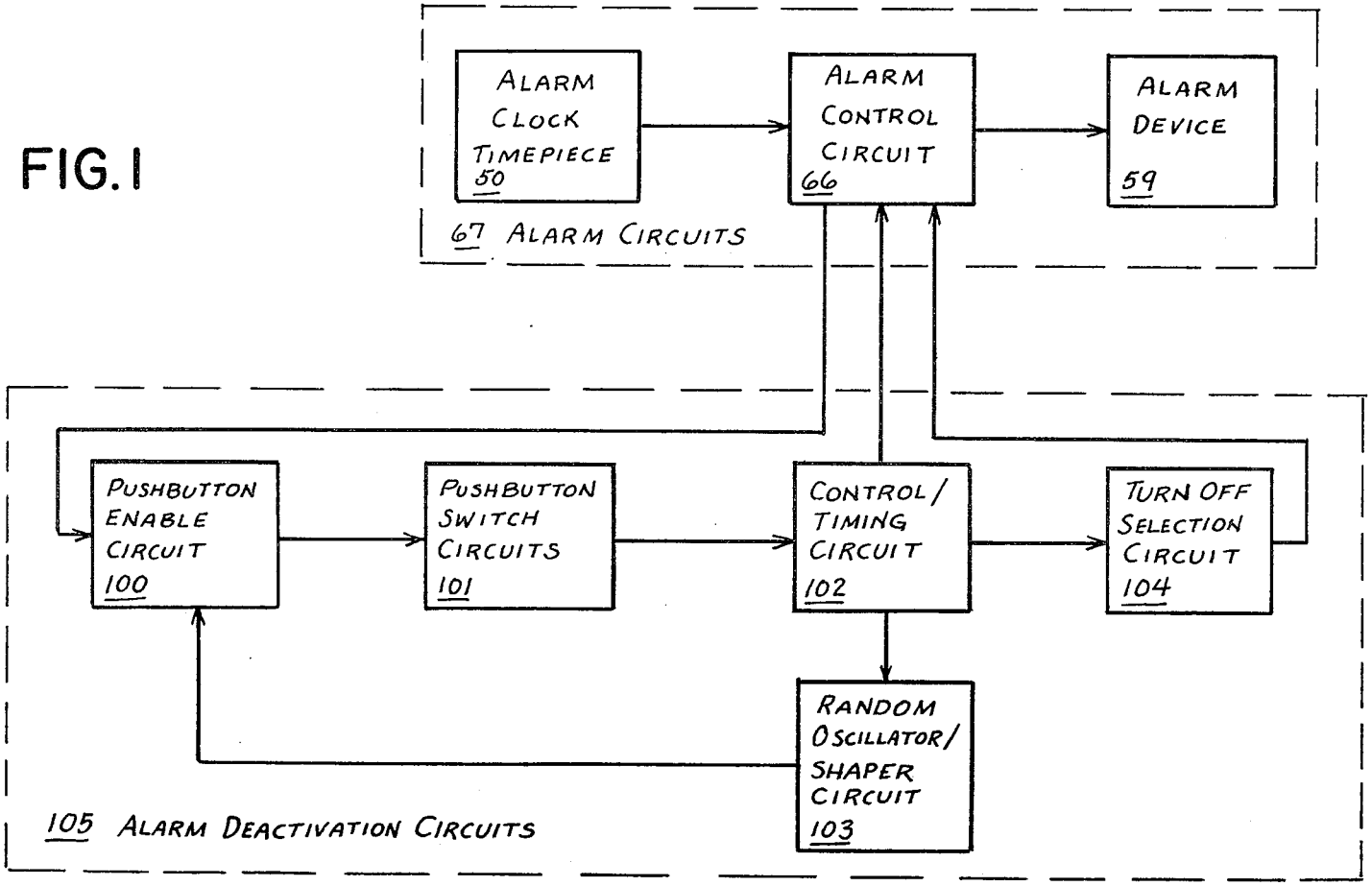
FIG. 1 is a block diagram of an improved alarm clock deactivation system constructed in accordance with the present invention.

Referring to the drawings, FIG. 1 illustrates, in block form, a clock with an alarm deactivation system according to the present invention. The clock broadly comprises two groups of circuits, namely, alarm circuits 67 and alarm deactivation circuits 105.

Alarm circuits 67, except for limited deviations, contain the general features of a modern standard electronic alarm clock.

Alarm deactivation circuits 105 employ a unique system for turning off an alarm clock. It contains eight momentary pushbutton switches, a selected number of which must be depressed in a random sequence and within a prescribed time interval in order to permanently turn off the clock alarm. The user preselects the number of pushbutton switches that he finds necessary to operate in order to become fully awakened after being aroused by the alarm.

The alarm clock timepiece 50 of alarm clock circuit section 67 is equivalent to a conventional alarm clock timepiece which provides a readout in real time and can be preset by the user to activate an alarm control circuit 66 at a selected time. The activation of the alarm control circuit is concurrent with the initiation of an alarm cycle.

Alarm control circuit 66 activates alarm device 59 which produces an audible tone for the purpose of awakening the user of the clock. Concurrently with activating alarm device 59, alarm control circuit 66 turns on pushbutton enable circuit 100. Alarm control circuit 66 will also, upon command from control/timing circuits 102, interrupt the operation of the alarm device during an alarm cycle. The interruption starts when the user initiates the alarm deactivation process by depressing the pushbutton switch that is first enabled. On later command from control/timing circuit 102, alarm control circuit 66 terminates an alarm cycle. A terminated alarm cycle is defined as having the alarm device permanently turned off and all the control and timing circuits reset to a standby state.

Pushbutton switch circuit section 101 includes eight identical pushbutton circuits each containing a momentary-operating pushbutton switch and an associated indicator light. Depressing a prescribed number of randomly selected pushbutton switches is the only means by which an alarm cycle can be terminated.

The eight pushbutton switch circuits are enabled one at a time through a random selection process provided by random oscillator/shaper circuit 103 and pushbutton enable circuit 100. The indicator light alerts the user as to which pushbutton switch has been randomly enabled. The indicator light associated with the randomly selected pushbutton switch is activated by a control signal from pushbutton enable circuit 100. Each time an enabled pushbutton switch is depressed (activated) by the user, two seconds later one of the eight pushbuttons will again be randomly selected. The two-second interval between the selection of pushbutton switches is provided by control/timing circuit 102. The user of the clock preselects the number of times a random selection of a pushbutton switch must be made before an alarm cycle can be terminated. This preselection is made by the user with an eight-position selector dial that controls circuitry in the turn-off selector circuit 104. Once an alarm cycle is initiated, the selector dial is uncoupled by alarm control circuit 66 so that no change in the number of random switch selections can be effected until the alarm cycle in use in terminated. When the first randomly selected pushbutton switch is depressed, control timing circuit 102 initiates operation of an eight-second timer. On successive depression of additional enabled pushbutton switches, the eight-second timer is forced to make a fresh start before completing its full eight-second time interval. This procedure is defined by the statement that the eight-second timer is "refreshed". If the user fails to refresh the eight-second timer, it will turn off after an eight-second duration, causing the alarm device to resume operation. The user will then be required to start from the beginning of a new sequence of depressing the randomly selected pushbutton switches. However, after the user has successfully depressed the prescribed number of randomly selected pushbutton switches in the proper time sequence, the turn-off selection circuit 104 sends a turn-off command signal to alarm control circuit 66 which in turn permanently terminates the alarm cycle.

Since all of the clock circuits operate from a conventional power supply, a description of the power supply is not furnished herein.

Figure 2A:
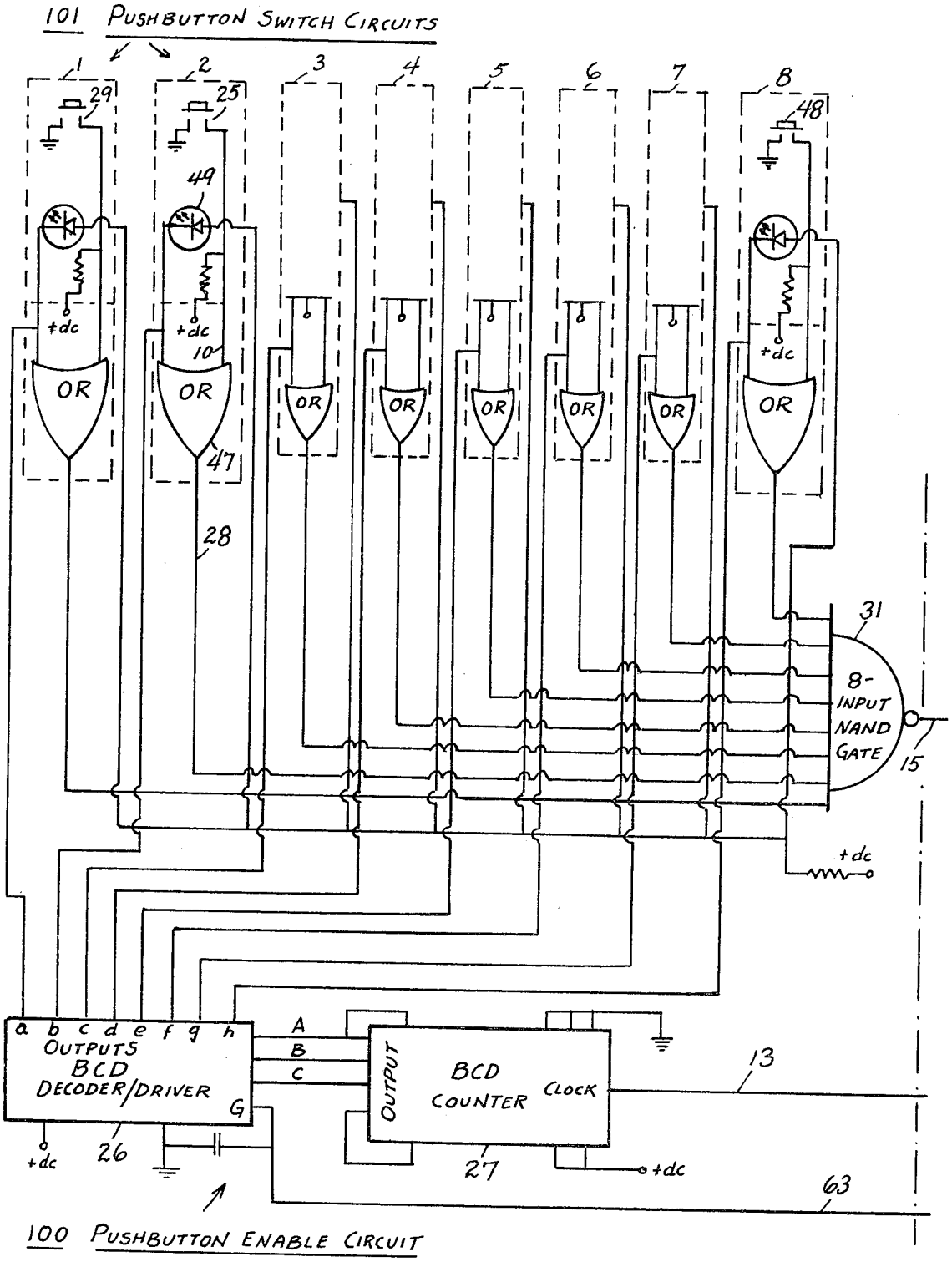
FIGS. 2A, 2B and 2C, taken together, form a detailed schematic diagram of the alarm clock deactivation system of FIG. 1.
Figure 2B:
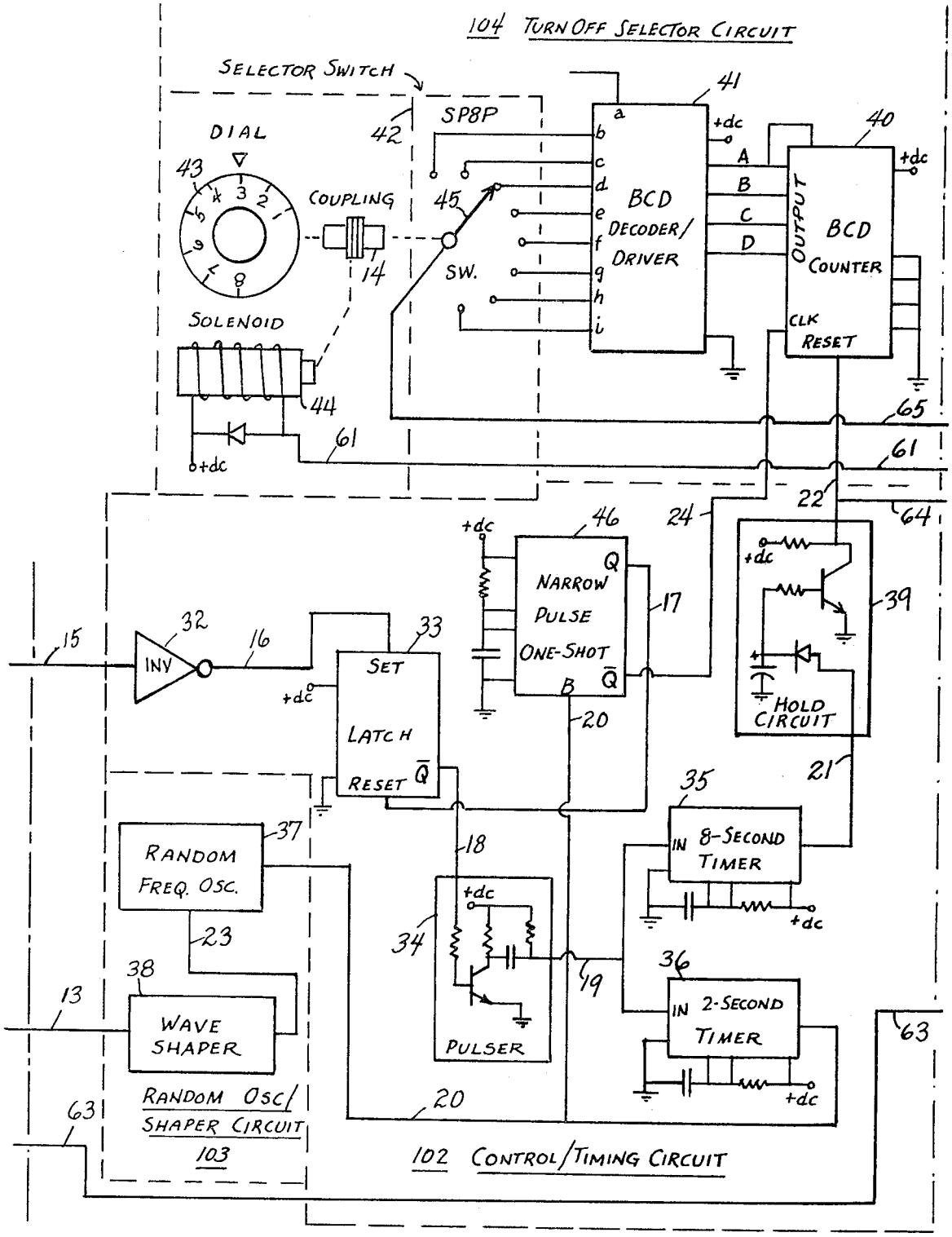
Figure 2C:
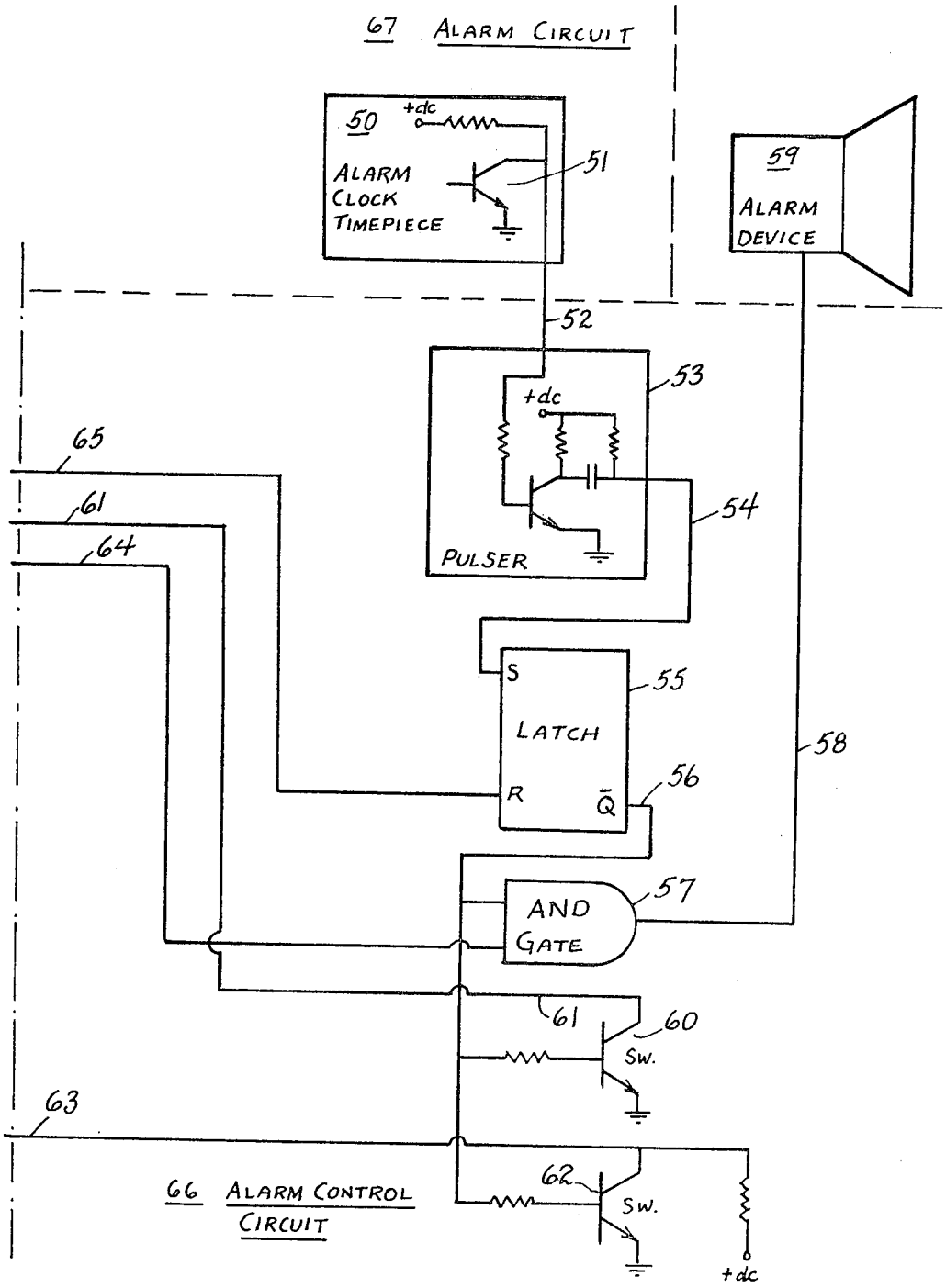

Referring to FIGS. 2A, 2B and 2C, the alarm clock timepiece 50 is a conventional timepiece which can be preadjusted by the user to activate an alarm switch at a selected time. In addition to selecting an alarm starting time, the user has to preset selector dial 43 (FIG. 2B) to the number of pushbutton switches that must be sequentially depressed in order to successfully deactivate the alarm. For the purpose of this discussion it is assumed that the user has preset the selector dial 43 at position number "3". At the selected time, the output of transistor alarm switch 51 (FIG. 2C) of alarm clock timepiece switches to a high logic level ("H" level). This "H" logic level is applied on line 52 feeding pulser 53. The output pulse on line 54 from pulser 53 sets latch 55, changing its Q terminal output to the "H" level, which is applied to line 56. The "H" level on line 56 activates AND gate 57, which is already in an enabled state because an "H" logic level is on the other input. It is to be noted that an AND gate cannot be activated when either input is held at the "L" level. The "H" level on line 58 is fed to alarm device 59, which causes it to produce an audible tone. When the alarm circuits become activated and the audible tone is produced, this denotes that an alarm cycle is in progress. The "H" logic level on line 56 branches to the input of two other devices, namely, transistor switches 60 and 62. The "H" level on line 56 turns transistor switch 60 on, causing solenoid 44 (FIG. 2B) of turn-off selector circuit 104 to be activated. When solenoid 44 is activated, it decouples shaft 14 from dial 43 so that it cannot change the setting of selector switch 42 for the duration of the alarm cycle. Returning to transistor switch 62 (FIG. 2C) which also received at its input the "H" logic level on line 56, the "H" level applied to the input of transistor switch 62 causes its output to apply a "L" logic level on line 63. The "L" logic level on line 63 is applied to the "G" terminal of BCD decoder/driver 26 (FIG. 2A), resulting in its being activated. When BCD decoder 26 is activated, it enables the first pushbutton switch circuit randomly selected for the user to use in the deactivation process for permanently terminating an alarm cycle. The circuit functions that randomly select and enable the first pushbutton switch circuit will be described further on in this discussion. Up to this point the circuit functions described have shown how an alarm cycle is set in operation. Starting with the premise that selector dial 43 has been set to position number "3", as shown, an alarm cycle has started, and BCD decoder 26 of pushbutton enable circuit 100 has been activated. The deactivation of an alarm cycle will be next described.

BCD counter 27 (FIG. 2A) has in storage a randomly selected binary number. This stored binary number resulted from the last time that BCD counter 27 was clocked. BCD decoder 26 decodes this stored binary number which, in this example, results in the activation of line "b". Consequently, line "b" of BCD decoder 26 is switched from an "H" level to a "L" logic level, while the remaining lines "a" and "c" through "h" remain at the "H" level. The "L" level on line "b" is applied to pushbutton switch circuit number "2∞. From the above circuit functions, it follows that pushbutton switch 25 is the first of the eight switches randomly selected. The "L" logic level on line "b" is applied to one input of OR gate 47 and to one terminal of pushbutton switch indicator light 49. Consequently, OR gate 47 is enabled and indicator light 49 illuminates. The illuminated indicator light 49 alerts the user that pushbutton switch 25 is in use. The user starts the alarm deactivation process by depressing pushbutton switch 25. When pushbutton switch 55 is depressed (activated) it applies a "L" level on line 10 which feeds one input of OR gate 47. With both inputs to OR gate 47 at a "L" level, its output changes to a "L" logic level. The "L" level output of OR gate 47 is applied to line 28 feeding one input of 8-input NAND gate 31. All of the inputs to 8-input NAND gate 31 are normally set at an "H" logic level. When any one of the eight inputs is changed to a "L" level, the output of 8-input NAND gate 31 switches to an "H" logic level. The "H" level output is applied to line 15 and fed to the input of inverter 32 (FIG. 2B). Inverter 32 inverts this logic level and applies a "L" level on line 16.

The low logic level on line 16 is applied to the "set" terminal of latch 33, causing its Q output to apply an "H" logic level on line 18. The "H" level on line 18 feeds pulser 34, causing it to produce a "L" logic level pulse which is fed on line 19. The "L" logic level pulse on line 19 is fed to the input of both timers 35 and 36. The resulting action of 2-second timer 36 will be discussed first. The "L" level pulse to 2-second timer 36 causes it to generate an "H" level output signal for a period of two seconds. Its output is applied to line 20 which feeds both narrow pulse one-shot 46 and random frequency oscillator (RFO) 37. RFO 37 is gated on for a time period of two seconds, generating a band of random frequencies. The ratio of the time-on period divided by the time period of any frequency in the band of random frequencies is very high. The output of RFO 37 is fed on line 23 to the input of wave shaper 38. Wave shaper 38 converts the input signals into a representative chain of random logic level pulses and applies them serially on line 13. BCD counter 27 (FIG. 2A) counts each pulse received serially on line 13 at its clock input terminal and applies a representative binary coded decimal number from "0" to "7" on output lines "A", "B", and "C". BCD counter 27 functions as a recirculatinhg counter. When the binary number "7" is reached, the counter starts counting over again from zero. These binary numbers repeatedly ripple through the counter many times during a two-second period because of the previously cited band of random frequencies generated by RFO 37. The output lines "A", "B" and "C" from BCD counter 27 carry the binary number to the input of BCD decoder 26. BCD decoder 26 decodes each input binary number and activates one of its eight output lines "a" through "h" accordingly. The activated output line of BCD decoder 26 is switched to a "L" logic level while all of the other output lines remain at the "H" level. The status of each of the output lines "a" through "h" is fed to one input of a respective OR gate and one terminal of the indicator light contained in its respective associated pushbutton switch circuit. As cited previously, BCD counter 27 only operates for two seconds. At the end of two seconds, one of the binary coded decimal numbers "0" to "7" has been randomly selected and held in storage. Consequently, one of the output lines of BCD decoder/driver 26 becomes first at a low logic level and is applied to its respective pushbutton switch circuit. It is to be noted that this is the second pushbutton switch circuit to be randomly selected, leaving one more switch circuit completion to complete the description of the alarm cycle dectivation process. For the benefit of this discussion, it is assumed that the second pushbutton switch circuit randomly selected is switch number "8". The circuit operation described above has just completed the first pushbutton switching loop of an active alarm cycle. The circuit operation after a pushbutton is depressed and the next pushbutton is randomly selected is construed to be the completion of a pushbutton switching loop. During the operation of this loop, other circuits are simultaneously functioning to preserve an account of the number of pushbutton switches depressed. A description of the circuits providing this counting function will be included in further discussion of the deactivation process.

Referring to FIG. 2B, it wil be seen that the output of pulser 34 feeds a "L" level pulse to the input of 8-second timer 35 via line 19. The output of 8-second timer 35 applies an "H" logic level on line 21 for a duration of eight seconds. The "H" level on line 21 is applied to hold circuit 39. The output of hold circuit 39 feeds a "L" logic level on lines 64 and 22. The "L" logic level on line 64 feeds one input of AND gate 57 (FIG. 2C) causing its output to shift to a "L" logic level which interrupts the operation of alarm device 59. The object of this interruption is to silence tha alarm device so that it is not audible to others, providing that the user is successfully persuing the pushbutton switch deactivation process.

The "L" logic level on line 22 is applied to the "RESET" terminal of BCD counter 40, causing the counter to furnish at its output a 4-bit binary coded decimal number of "1" on its output lines "A", "B", "C" and "D". This binary number is applied to the input of BCD decoder/driver (BCD decoder) 41, causing its activated output to apply a "L" logic level on its output line "a" while its remaining output lines "b" through "i" stay at the "H" level. The "L" logic level on output line "a" of BCD decoder/driver 41 is the reference from which each enabled pushbutton switch depressed will result in a shift in ascending order of the "L" logic level to the next output line. The following discussion will explain how this shift is accomplished.

Returning to the output of one-shot 2-second timer 36, a two-second "H" level signal is fed on line 20 to terminal "B" of narrow pulse one-shot 46. One-shot 46 is activated on the trailing edge of the two-second "H" level input signal. In effect, this results in a two-second delay of the "Q" and Q signal outputs of narrow pulse one-shot 46 in reference to the time that latch 33 was set and BCD counter 40 was reset. The Q output applies an "H" level pulse on line 24 which feeds the clock (CLK) terminal of BCD counter 40, causing it to shift one count. When BCD counter 40 counts its first clock pulse, a representative output 4-bit binary coded decimal is applied on it output lines "A", "B", "C" and "D" feeding BCD decoder 41. After BCD decoder 41 decodes this binary number, its output line "a" is shifted to a "H" level and its output line "b" is shifted to a "L" level. All other output lines of the decoder 41 will remain at the "H" level. It is to be noted that BCD decoder 41 shifts its active output ("L" level logic) progressively from its output line "a" toward its output line "i" for every clock pulse received by BCD counter 40. The output lines "b" through "i" are connected to separate contacts on single pole-eight position (SP8P) switch 42 (FIG. 2B). In the alarm cycle deactivation process being described, a "L" logic level must reach line "d" of BCD decoder 41 in order to be applied to rotary contact 45 of SP8P switch 42, in accordance with the illustrated setting of dial 43.

Up to this point it has been described how depressing the first randomly selected pushbutton switch sets circuitry in action to accomplish the following: (1) effect a pushbutton switch loop which randomly enabled pushbutton switch circuit 37 8" (FIG. 2A); (2) started the 8-second timer 35 (FIG. 2B) which initiated a signal to reset BCD counter 40, that in turn activated output line "a" of BCD decoder 41; (3) started one-shot 2-second timer 36 which initiated circuit functions that clocked BCD counter 40 one count, which in turn caused BCD decoder 41 to shift its activated "L" logic level from its output line "a" to its output line "b"; and sets all circuits in readiness to repeat their function when the second-enabled pushbutton switch is depressed.

When the second randomly selected pushbutton switch 48 (FIG. 2A) of pushbutton switch circuit "8" is pushed, the circuit functions previously discussed are repeated, except for the following: (1) 8-second timer 35 is restarted (refreshed) by the narrow input pulse from pulser 34. The output of the timer switches to a low level for the short interval of the narrow input pulse while hold circuit 39 buffers this timer change from affecting the "L" level applied on lines 22 and 64; (2) the output of BCD decoder 41 shifts its "L" logic level from its output line "b" to its output line "c"; and (3) in the process of completing the second pushbutton switch loop, pushbutton switch circuit "1" is randomly activated.

Pushbutton switch 29 of pushbutton switch circuit "1" is the third and final switch used in the example selected to describe how an alarm cycle is deactivated. When pushbutton switch 29 is depressed, the circuit functions described after pushbutton switch 48 was depressed are repeated, except for the following: (1) the output of BCD decoder 41 shifts its "L" logic level from line "c" to line "d"; (2) the "L" level on line "d" is applied to rotatable arm 45 of SP8P switch 42 and conducted on line 65 to the "R" terminal of latch 55 (FIG. 2C); (3) the "L" logic level applied to the "R" terminal of latch 55 resets its Q output to a "L" logic level, causing the alarm cycle to be terminated and the other circuits of alarm control circuit 66 to be returned to their standby state to await the next alarm cycle; (4) the output of transistor switch 60 returns to its "H" logic level, which deactivates solenoid 44 (FIG. 2B); (5) the deactivated solenoid 44 reengages dial 43 through coupling 14 to SP8P switch 42; (6) the output of transistor 62 returns to its "H" logic level, feeding via line 63 this logic level to the "G" terminal of BCD decoder/-driver 26; (7) the "H" level fed to the "G" terminal of BCD decoder/driver 26 causes all of its output lines "a" through "h" to remain at the "H" logic level so that none of the pushbutton switch circuits 101 will be activated; and (8) the third and final pushbutton switch loop ends with BCD counter 27 storing a new randomly selected binary number which, as previously discussed, predetermines the pushbutton switch circuit that will be first enabled whenever a new alarm cycle is activated.

In the circuit functions previously described, it was the presumption that the user preset the selector switch dial 43 to the number "3" position. Also it was presumed that the user did not exceed the six-second time interval between sequentially depressing the three enabled pushbutton switches in order to achieve deactivation of the alarm cycle. Had the user exceeded the six-second time interval, alarm device 59 would have become active and the user would have been required to start on a fresh series of randomly selected pushbutton switches in another attempt to deactivate the alarm cycle. Consequently, the time it takes to deactivate an alarm cycle will be extended in accordance with the number of failures the user has in not adhering to the six-second time interval. A review of the circuits previously described will reveal how this six-second time interval is obtained. It will be noted that the operation of 2-second timer 36 and 8-second timer 35 are simultaneously initiated by pulser 34. Also, that pushbutton switch circuits 101 are inactive during the operating interval of 2-second timer 36. Consequently, a pushbutton switch can only be used in the alarm deactivation process between the end of the operating times of the 2-second timer and the 8-second timer, which equals the six seconds discussed above.

Figure 4:
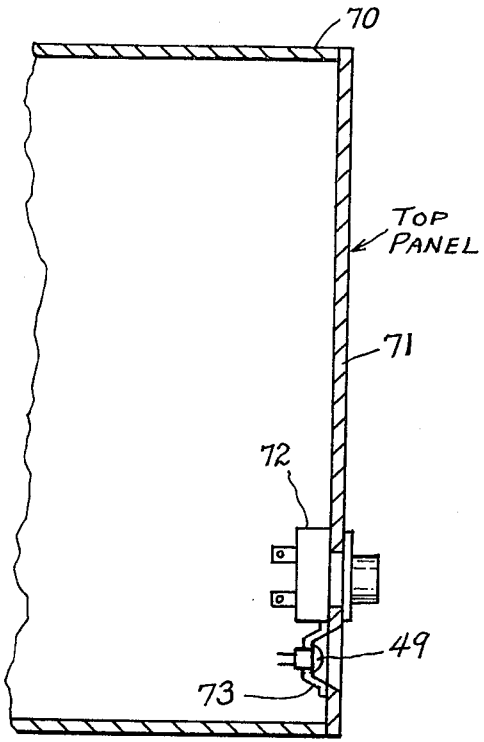
FIG. 4 is a fragmentary transverse vertical cross-sectional taken substantially on line 4—4 of FIG. 3.
Figure 3:
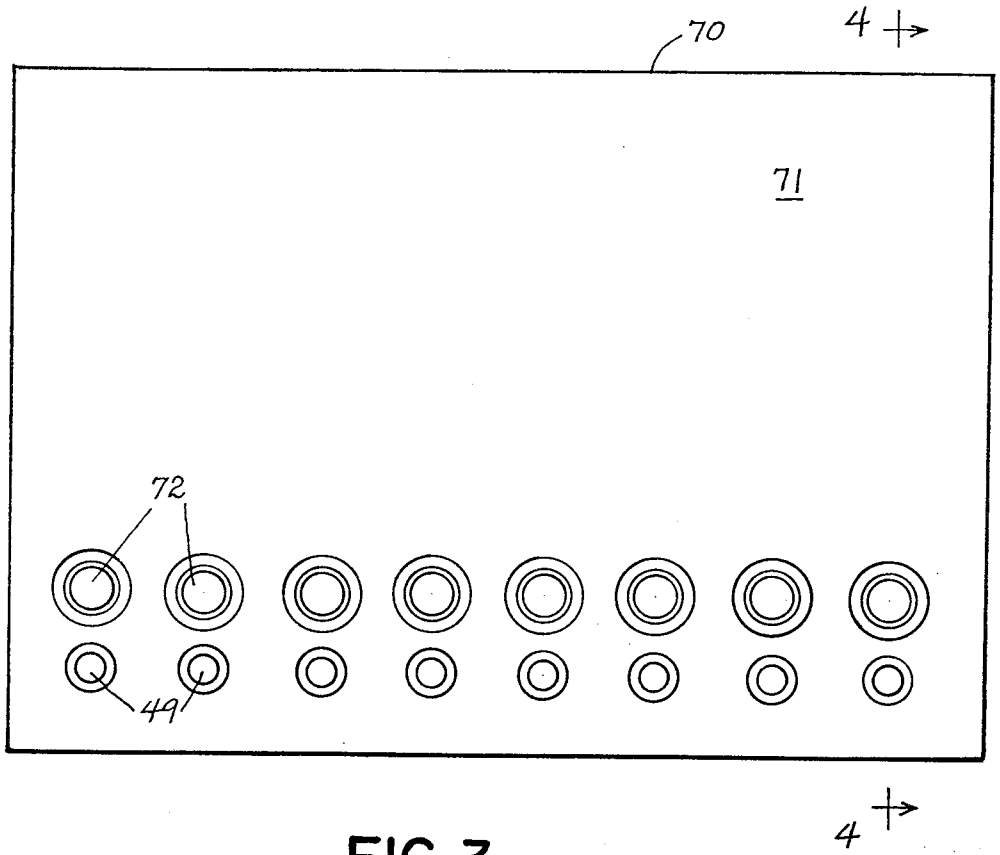
FIG. 3 is a top plan view of the operating panel of a typical clock alarm deactivation device according to FIGS. 1, 2A, 2B and 2C, showing one possible configuration of pushbutton switches and associated pushbutton indicator lights which may be employed with the present invention.

FIGS. 3 and 4 illustrate one possible physical configuration of pushbutton switches and associated indicator lights 49 which may be employed in a typical clock alarm deactivation device according to the present invention. Thus, the clock housing 70 has a top panel 71, with eight pushbutton switches, designated generally at 72, and associated indicator lights 49 mounted on said top panel in a linear longitudinal array along the front mariginal portion of the panel, with the indicator lights 49 located in front of the respective switches. As shown in FIG. 4, the indicator lights 49 are mounted in recessed supporting bracket cups 73 which support the indicator lights substantially below the surface plane of the top panel 71. Mounting the indicator lights 49 at this depressed level reduces their field of view, making it necessary for the user to exert some extra effort to see which indicator light is illuminated. Consequently, this adds another significant dimension to the mental concentration required in the use of the randomly selected pushbutton switches.

While a specific embodiment of an improved clock alarm deactivation device has been disclosed in the foregoing description, it will be understood that various modifications within the scope of the invention may occur to those skilled in the art. Therefore it is intended that adaptations and modifications should and are intended to be comprehended within the meaning and range of equivalents of the disclosed embodiment.

What is claimed is:

1. An alarm clock system comprising an alarm clock timepiece including alarm starting means for producing an electrical alarm signal, alarm means to generate an audible alarm responsive to said electrical alarm signal, alarm deactivation switch means comprising a plurality of switch circuits, each having a manually operated switch and an associated visual indicator, means to randomly enable a first switch circuit and simultaneously energize its visual indicator responsive to said alarm signal, means to sequentially randomly enable one or more of the other switch circuits and simultaneously energize their associated visual indicators responsive to successive operation of their manually operated switches as their associated visual indicators become energized, circuit means to disable said alarm means temporarily responsive to operation of the manually operated switch of the first switch circuit, and means to permanently disable the alarm means for the duration of said alarm signal responsive to sequential operation of a predetermined number of those manually operated switches whose associated visual indicators become sequentially energized.

2. The alarm clock system of claim 1, and means to variably select the total number of manually operated switches required to be operated in sequence for permanently disabling said alarm means for the duration of said alarm signal.

3. The alarm clock system of claim 2, and means to disable said selecting means during the period between the onset of the alarm signal and the operation of the last manually operated switch in the selected sequential series.

4. The alarm clock system of claim 3, and wherein said selecting means includes a number-selecting dial, a rotary selecting switch, decoupling means between the dial and the rotary switch, and means to activate said decoupling means during said period between the onset of the alarm signal and the operation of the last manually operated switch.

5. The alarm clock system of claim 1, and timing means connected to said alarm-disabling circuit means to prevent the enabling of said alarm-disabling circuit means unless each manually operated switch is operated within a predetermined time period after energization of its associated visual indicator.

6. The alarm clock system of claim 1, and means to prevent activation of said alarm-disabling circuit means if any of the manually operated switches in said predetermined number of switches is not operated within a predetermined time period after energization of its associated visual indicator.

7. The alarm clock system of claim 6, and means to reset said alarm-disabling circuit means to its starting condition and cause resumption of the audible alarm if any of the manually operated switches in said predetermined number of switches is not operated within said predetermined time period.

8. The alarm clock system of claim 1, and means imposing a time limit for sequentially enabling said other switch circuits after the visual indicators for preceding switch circuits become energized.

9. The alarm clock system of claim 1, and means imposing a time delay for sequentially enabling said other switch circuits after the visual indicators for preceding switch circuits become energized.

10. The alarm clock system of claim 1, and wherein the means to randomly enable the switch circuits includes a random frequency oscillator, means to shape the output of said oscillator into random frequency-dependent pulses, means to count said pulses, and circuit means to selectively enable said other switch circuits in accordance with the pulse counts.

11. The alarm clock system of claim 10, and storage means to store the last count produced by the sequential operation of the manually operated switches involved in enabling said other switch circuits to permanently disable said alarm means for the duration of said alarm signal, whereby the stored count is usable to randomly select the first switch circuit of a future alarm deactivation cycle.

12. The alarm clock system of claim 1, and wherein the means to randomly enable the switch circuits includes a random frequency oscillator, means to gate on said oscillate for a predetermined time period beginning concurrently with the commencement of energization of each visual indicator, means to shape each timed output of the oscillator into a chain of random logic level pulses, means to serially count said pulses, and circuit means to selectively enable said other switch circuits in accordance with the pulse counts.

13. The alarm clock system of claim 12, and means to inhibit activation of said alarm-disabling circuit means if any of the manually operated switches identified by energizaion of its visual indicator is not operated within a predetermined second time period following said first-named predetermined time period.

14. The alarm clock system of claim 13, and means resetting said alarm-disabling circuit means to its starting condition and causing resumption of the audible alarm if any of the manually operated switches in said predetermined number of switches is not operated within said second predetermined time period.

15. The alarm clock system of claim 13, and means to variably preset the total number of manually operated switches to be operated in sequence for permanently disabling said alarm means for the duration of the alarm signal.

16. The alarm clock system of claim 13, and storage means to store the last pulse count produced by the sequential operation of the manually operated switches of said switch circuits to permanently disable said alarm means for the duration of said alarm signal, whereby the stored count is usable to randomly select the first switch circuit of a future alarm deactivation cycle.

17. The alarm clock system of claim 13, and changeable means to variably preset the total number of manually operated switches to be operated in sequence for permanently disabling said alarm means for the duration of the alarm signal, and means to inhibit operation of said changeable means during the period between onset of the alarm signal and the operation of the last manually operated switch in the selected sequential series of manual switch operations.

18. The alarm clock system of claim 1, and wherein the alarm clock timepiece is provided with a housing having an upwardly facing panel, wherein the manually operated switches comprise switches arranged in a linear array on said panel, and wherein the visual indicators are mounted so as to be respectively visually associated with the individual switches.

19. The alarm clock system of claim 1, and wherein the alarm clock timepiece is provided with a housing having an upwardly-facing panel, wherein the manually operated switches comprise switches arranged in a linear array on said panel, and wherein the visual indicators are mounted on the panel adjacent the respective switches.

20. The alarm clock system of claim 19, and wherein the visual indicators are mounted in respective recessed support elements which support the visual indicators substantially below the surface plane of said panel.

* * * * *